United States Patent [19]

Bress et al.

[11] 4,134,738

[45] Jan. 16, 1979

[54] AUTOMATED POKING SYSTEM FOR COAL GASIFIER

[75] Inventors: Dellason F. Bress, Murray Hill; Joseph N. Conover, New Providence, both of N.J.

[73] Assignee: Foster Wheeler Energy Corporation, Livingston, N.J.

[21] Appl. No.: 895,030

[22] Filed: Apr. 10, 1978

[51] Int. Cl.[2] ..... C10J 3/32

[52] U.S. Cl. ..... 48/85.2; 48/66; 48/73; 48/87; 73/344; 202/265; 266/87; 266/99; 266/197; 432/98

[58] Field of Search ..... 48/85.2, 85.1, 66, 87, 48/77, 76, 73; 202/175, 265; 432/98, 139, 151; 366/145, 241; 266/99, 87, 197; 73/343, 344

[56] References Cited

U.S. PATENT DOCUMENTS

| | | | |
|---|---|---|---|
| 953,497 | 3/1910 | Swindell | 48/85.2 |
| 1,210,471 | 1/1917 | Herrick | 48/85.2 |
| 3,983,756 | 10/1976 | Danguillier et al. | 73/343 |

*Primary Examiner*—Richard V. Fisher
*Assistant Examiner*—George C. Yeung
*Attorney, Agent, or Firm*—Marvin A. Naigur; John J. Herguth, Jr.; John E. Wilson

[57] ABSTRACT

An automated poking system includes a plurality of pokerod assemblies positioned around the periphery of a two-stage, fixed-bed coal gasifier at two separate elevations. Each pokerod assembly includes an elongated pokerod selectively actuatable to extend into the coal bed within the gasifier, and appropriate sensors to provide data relating to the temperature of the coal bed, the resistance encountered by the pokerod, and the position of the pokerod. Alternatively, the temperature sensing function is separate from the pokerod activation, and the coal bed temperature is continuously moinitored. The mechanism for controlling activation of the pokerod may be a hydraulic cylinder-piston device or an electric motor driving the pokerod via mechanical means, such as a rack and pinion apparatus. Poking of the lower zone coal bed agitates the bed, detects and breaks up clinkers, and monitors the coal bed temperature. Poking of the upper zone breaks up agglomerates which form when caking coals, characterized by a high free swelling index, are charged to the gasifier.

24 Claims, 6 Drawing Figures

AUTOMATED POKING SYSTEM FOR COAL GASIFIER

BACKGROUND OF THE INVENTION

This invention relates generally to gasifiers and, more particularly, to an automated system for monitoring the condition of and for agitating the coal bed inside a coal gasifier.

Two-stage, fixed-bed, coal gasifiers have been in existence for many years, having been developed and employed mainly in Europe and South Africa. In operation, coal is fed into the upper or distillation zone of the gasifier, while a mixture of steam-and-air is introduced into the bottom. A small amount of coal is completely oxidized to provide the heat required to gasify carbon in the lower zone and distillation of the feed coal volatile matter in the upper zone. The gases thus produced are collected and used as a fuel in burners designed for this purpose.

The condition of the lower zone coal bed inside the gasifier has to be checked periodically in accordance with a planned, maintenance schedule. Generally, this checking procedure is accomplished by manually inserting a steel pokerod into one of several pokeholes, or ports, which are spaced around the perimeter of the gasifier and which orient the pokerod, and pushing the pokerod to penetrate the layer of coal, and to stop at the center of a grate positioned at the bottom of the gasifier. The insertion of the pokerod performs two important functions: (1) the detection of clinkers, or coal which has been fused together, in the fire zone, which is achieved by the operator feeling obstructions to the passage of the pokerod being inserted into the coal bed; and (2) the measurement of the depth of the fire zone, the area of the most intense burning of the coal, which is accomplished by visually observing the discoloration of the pokerod after it has been left in place for a couple of minutes, and then withdrawn.

Because of the frequency of the required poking operation, and the number of pokeholes which must be checked, this procedure for checking the condition of the coal bed usually requires from one to three operators per shift, depending upon the number of gasifiers at the plant. Where the labor cost is relatively inexpensive, this procedure presents no problem. However, in high labor cost markets, such as the United States, for example, this poking operation becomes a costly operating expense. In addition, the determination of incipient clinker formation and bed temperature is achieved in an unscientific manner and depends upon the human reaction to the poking force and pokerod color. A further problem is that these characteristics are usually transmitted verbally to the person actually in charge of making the changes necessary.

When coal is heated in the absence of oxygen, the coal structure expands, or swells and the free swelling index is used as a measure of the amount of swelling experienced by the coal. The use of coal with a free swelling index greater than 2.7 in this type of fixed-bed gasifier is not now possible since the coal will swell and plug the distillation zone of the gasifier where the coal is heated to the 700°-800° F. temperature range. By agitating or poking the coal bed, the gases causing the swelling are released from the coal structure to reduce excessive swelling, and thus permit the use in a gasifier of coal having a free swell index greater than 2.7.

SUMMARY OF THE INVENTION

Accordingly, it is an object of the present invention to provide a system for checking the condition of and for agitating the coal bed within a coal gasifier.

Another object of the present invention is to provide a system of the above type which will prevent excessive swelling and agglomeration of coal having a high free swelling index as it is heated in the absence of oxygen.

Another object of the present invention is to provide a system of the above type which is automated and can be selectively controlled.

Still another object of the present invention is to provide a system of the above type which can detect abnormal conditions in the coal bed, such as clinkers, and measure the temperature of the coal bed at different levels within the thickness of the bed.

A further object of the present invention is to provide a system of the above type in which the checking for clinkers and the measurement of the temperature of the coal bed is accomplished in a single operation.

Still a further object of the present invention is to provide a system of the above type in which the temperature of the coal bed is continuously monitored at different levels, and in which the condition of the coal bed is selectively checked.

Yet another object of the present invention is to provide a system of the above type which will provide an automated process for checking the condition of the coal bed within a gasifier, reduce operating costs, and provide a permanent record of operating parameters associated with the gasifier to permit achieving optimum output and operating conditions.

Toward the fulfillment of these and other objects, an automated poking system is provided for a coal gasifier, which can be selectively operated to agitate the coal bed, determine the existence of abnormal conditions, such as the existence of clinkers within the coal bed, prevent excessive swelling and agglomeration of coal having a high free swelling index heated in the absence of oxygen, and to determine the temperature of the coal bed at different levels within the bed. The automated poking system comprises a plurality of pokerod assemblies positioned around the circumference of the gasifier at two height levels, one such level located in the lower or gasification zone and a second in the upper or distillation zone. Each pokerod assembly has a driving means, such as a hydraulic cylinder, provided with a load cell and supported on a mounting tube, and a pokerod which is internally provided with a plurality of thermocouples.

Upon activation of each pokerod assembly, the hydraulic cylinder extends the pokerod from a retracted position within the mounting tube, to the center of the coal bed, with the load cell registering the force exerted upon the pokerod. An abnormally-high force registered by the load cell indicates the probable existence of a clinker within the bed. A position sensor operates in connection with the hydraulic cylinder to provide a signal indicating the position of the pokerod during the extension and retraction thereof. The plurality of thermocouples, which are equally spaced within the pokerod, register the temperature of the coal bed at different levels. The extension and retraction of the pokerod by the hydraulic cylinder serves to agitate the coal bed, and agitation of the coal bed by the pokerod assemblies positioned in the distillation zone of the gasifier prevents excessive swelling of the coal. Regulation of the pokerod assemblies may be controlled by a single operator from a central location, and data generated by the load cell, position sensor and thermocouples may be displayed at this location, and may also be permanently recorded in a suitable manner.

Alternatively, the hydraulic cylinder may be replaced by an electric motor driving a rack and pinion or other mechanical device. Further, the determination of the temperature within the coal bed may be achieved separately from the coal agitating process by providing a plurality of temperature probes permanently positioned at selected location within both the distillation and gasification zones of the coal bed.

BRIEF DESCRIPTION OF THE DRAWINGS

The above description, as well as further objects, features, and advantages of the present invention, will be more fully appreciated by reference to the following description of presently-preferred but nonetheless illustrative embodiments in accordance with the present invention, when taken in connection with the accompanying drawings, wherein.

DESCRIPTION OF THE PREFERRED EMBODIMENTS

Figure 1:
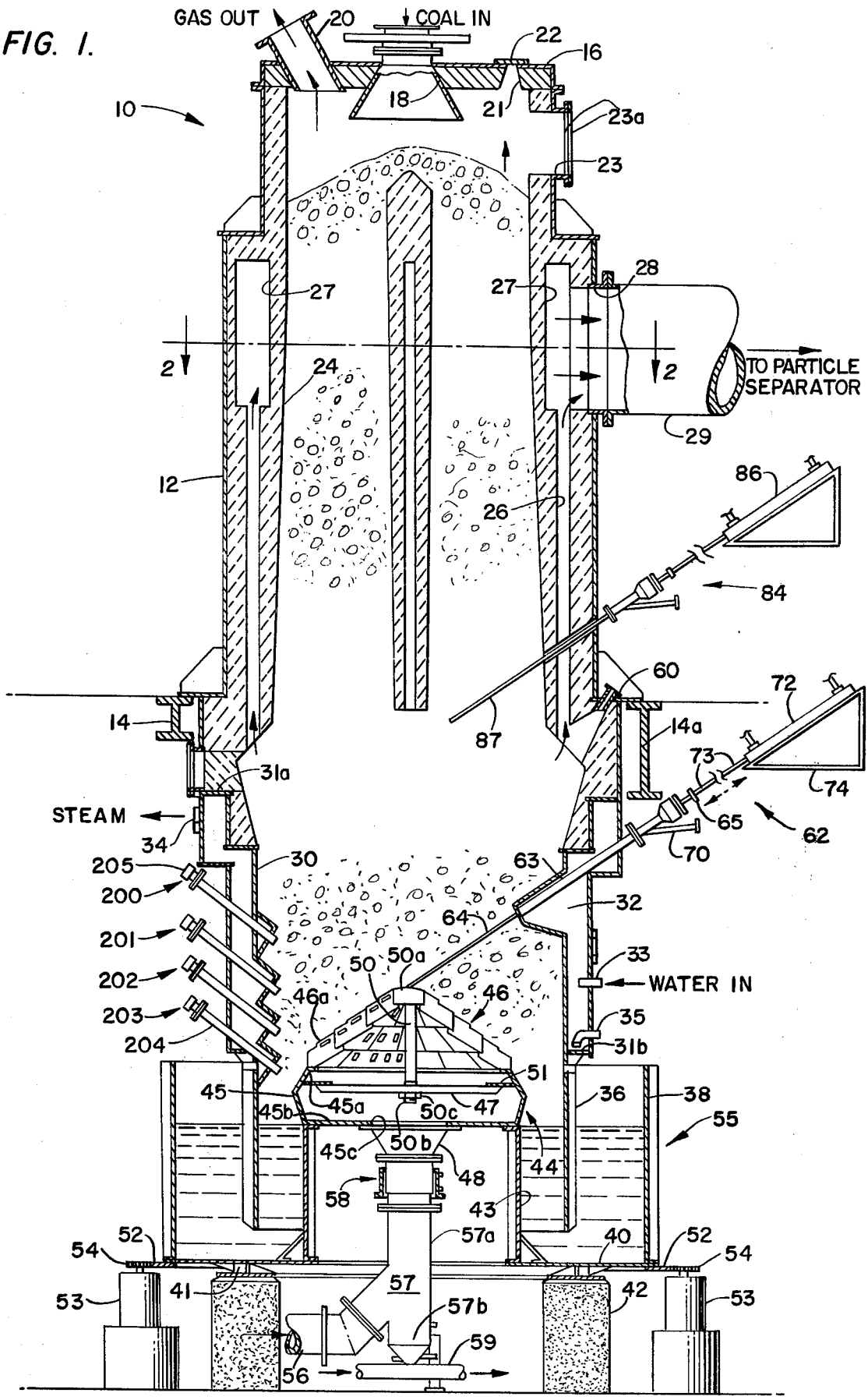
FIG. 1 is a cross-sectional, elevational view showing a coal gasifier incorporating an automated poking system of the present invention.

Referring specifically to FIG. 1 of the drawings, the reference numeral 10 refers generally to a coal gasifier, which may be of a fixed-bed, two-stage type, and which has an elongated, substantially cylindrical casing 12 vertically positioned and supported at an immediate height by supports 14 and 14*a*. The portion of the casing 12 which extends below the supports 14 and 14*a* is open at its lower extremity, and the portion of the casing extending above the supports is closed by a top closure 16. Extending centrally through the top closure 16 is a coal inlet 18 in the shape of an inverted funnel provided for the introduction of coal into the casing 12. An outlet conduit 20 also extends through the top closure 16, which may be connected to a suitable conduit (not shown) for conducting the gas generated in the gasifier 10 from the interior of the casing 12. Also disposed in the top closure 16 is a pokehole 21, which is normally closed by a cover 22, which provides access to the interior of the casing 12, and through which a pokerod may be inserted to break up any blockage of the coal introduced through the coal inlet 18. On the casing 12, at an elevation below the top closure 16, an opening 23, normally closed by a cover 23*a*, also provides access to the interior of the casing.

Figure 2:
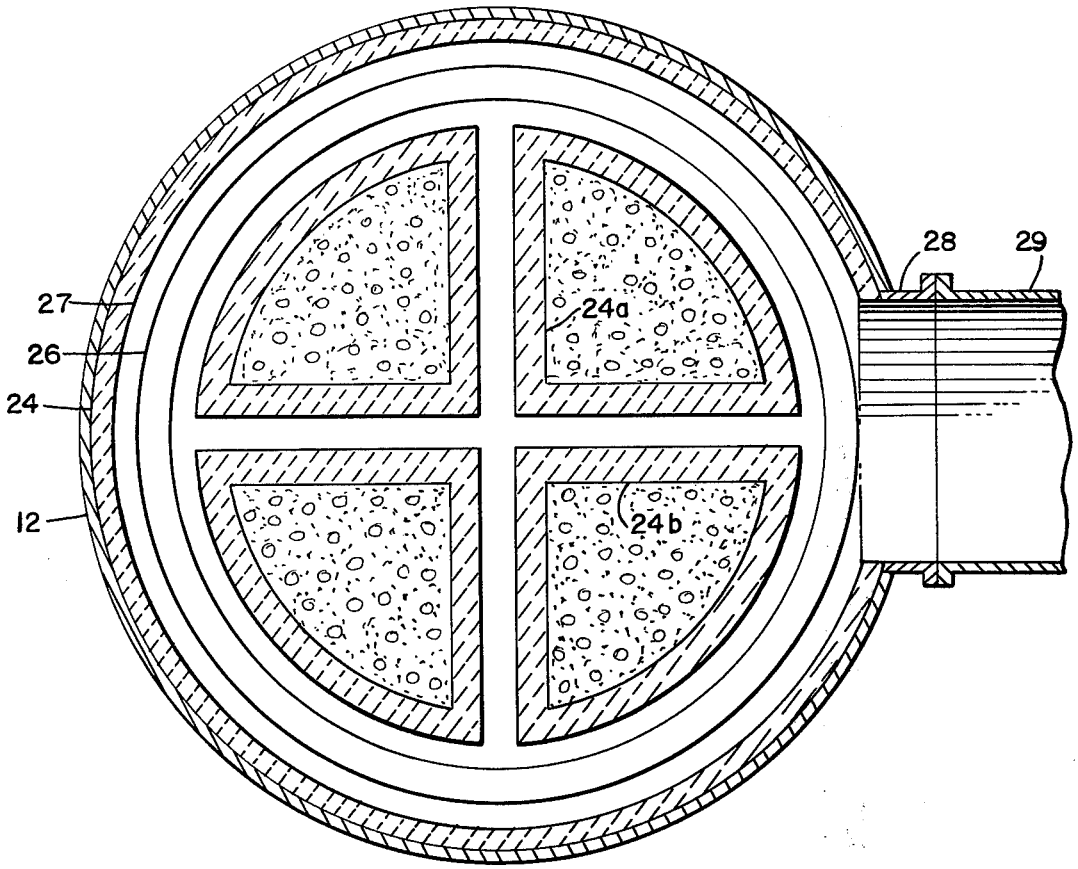
FIG. 2 is a cross section of the gasifier, as viewed along line 2—2 in FIG. 1.

As seen in FIG. 1, the upper portion of the casing 12 is provided with a tubular liner 24 of a suitable insulating material, such as refractory brick, which is appropriately attached to the inner surface of the casing and is supported thereby. As seen in FIGS. 1 and 2, the tubular liner 24 has an annular chamber 26 which extends substantially the height of the liner and is located within the thickness of the liner. An enlarged section 27 of the annular chamber 26 is also provided within the thickness of the tubular liner 24, which is in fluid communication with the annular chamber 26. When the tubular liner 24 is supported within the casing 12 in its proper position, the enlarged section 27 of the annular chamber is aligned with a second gas outlet 28 provided in the casing. The exterior end portion of the second gas outlet 28 is coupled to a conduit 29 which leads to a particle separator (not shown) for a purpose which will be described fully below.

As best seen in FIG. 2, the tubular liner 24 has diametrically-extending intersecting portions 24*a* and 24*b* which divide the interior of the casing 12 into four, separate regions which are not in fluid communication with each other. The division of the interior of the casing 12 by the tubular liner 24 aids in the even distribution of the coal introduced into the casing from the coal inlet 18, and the removal of the gas produced by the gasifier 10. The annular chamber 26 within the tubular liner 24 extends through the thickness of the diametric portions 24*a* and 24*b* to provide continuous, uninterrupted gas flow channels through the liner. As seen in FIG. 1, the lower end of the annular chamber 26 opens into the interior of the casing 12 so that the gas produced within the gasifier 10 enters the chamber, passes upwardly through the chamber, collects within the enlarged section 27, and passes from the casing through the outlet 28 and the conduit 29.

With continuing reference to FIG. 1, an inner casing 30 of a diameter smaller than the casing 12 is positioned within the lower portion of the latter casing, and an upper, annular connector plate 31*a* is secured to the upper edge of the inner casing 30 to attach the inner casing to the inner surface of the casing 12 so that the inner casing is supported in a manner to be spaced from the inner surface of the casing. A lower, annular connector plate 31*b* joins the lower extremity of the casing 12 to the outer surface of the inner casing 30 to define a steam chamber 32 in the volume bounded by the upper connector plate 31*a*, the lower connector plate 31*b*, the inner surface of the casing 12 and the outer surface of the inner casing 30. A fluid conduit 33 penetrates the casing 12 and extends into the steam chamber 32 to introduce water into the chamber from a source (not shown). Steam produced in the steam chamber 32 is removed through a steam outlet 34 which extends through the casing 12. A drain pipe 35 extends through the casing 12 adjacent to the lower portion of the steam chamber 32, and is provided with a valve (not shown) to permit draining of the chamber. A cylindrical lower portion 36 of the inner casing 30 extends below the lower connector plate 31*b* and the lower extremity of the casing 12 for a purpose which will be described below.

A cylindrical ash pan 38, which is of a larger diameter than the lower portion 36, is concentrically positioned exteriorly about the lower portion, and is attached at its lower end to the outer circumferential edge of an annularly-shaped pan floor 40. The upper end of the ash pan 38 is open to the atmosphere. The ash pan 38 and the pan floor 40 are rotatably supported by a skid ring 41 positioned between the lower surface of the pan floor and the top of a concrete plinth 42.

Still referring to FIG. 1, a cylindrical grate seal 43 is concentrically positioned within the lower portion 36 of the inner casing 30, and is attached at its lower end to the inner circumferential edge of the pan floor 40 in a fluid-tight manner and for rotation with the pan floor. The grate seal 43 supports a grate assembly 44 which includes a grate holder 45, a grate 46, and a grate support 47 securing the grate to the grate holder. The grate holder 45 may be a cylinder having an upper edge formed into a supporting flange or lip 45*a* which is directed radially inward, and a lower portion closed by a circular plate 45*b* perforated by a central cutout 45*c*. A downwardly-extending funnel 48 is supported adjacent to the edge of the cutout 45*c*.

The grate 46 may be of any suitable design which, when rotated along with the ash pan 38 and the grate seal 43, will cause the greater portion of the coal ashes to fall off the edge of the grate and into the ash pan. As an example only the grate 46 may be constructed of a plurality of perforated grate elements 46*a* which are arranged in a circular configuration of three, successively smaller-diameter rings, which are assembled in an overlapping fashion. The largest-diameter ring of grate elements 46*a* is supported on the upper flange 45*a* of the grate holder 45, and each of the successively smaller-diameter rings of grate elements is supported by a larger-diameter ring so that the overall configuration has a conical shape.

An elongated attachment element 50, having an enlarged head portion 50*a* at one end and a threaded portion 50*b* at the other end, passes through the apex of the overlapping rings of assembled grate elements 46*a*. The attachment element 50 extends downwardly and through a central aperture provided in the grate support 47, which may be a bar pressing against the lower surface of an annular lip 51 attached to the inner surface of the grate holder 45. The threaded portion 50*b* of the attachment element 50 which extends through the grate support 47 engages a nut 50*c* to press the grate support against the annular lip 51. The resulting force exerted by the attachment element 50 tends to hold the assembled rings of grate element 46*a* in the conical configuration shown in FIG. 1.

As indicated above, the grate seal 43 is attached at its lower end to the pan floor 40, and therefore rotates with the ash pan 38. Since the assembled grate elements 46*a* are attached to the upper edge of the grate seal 43 by the grate holder 45, the entire grate assembly 44 rotates with the ash pan 38. To achieve this rotary motion, a toothed, ratchet wheel 52 is attached to the outer periphery of the ash pan 38, adjacent to the lower edge thereof, and a motor 53, which may be hydraulically driven, is supported adjacent to the ratchet wheel. A gear 54, which is rotatably driven by the motor 53, meshes with and rotatably drives the ratchet wheel 52.

A water pipe (not shown) supplies water to the interior of the ash pan 38, and more particularly to the volume defined by the outer surface of the grate seal 43, the inner surface of the ash pan 38, and the pan floor 40, to form a water seal 55 for the lower portion of the gasifier 10. The lower portion 36 of the inner casing 30 thus functions as a skirt for the water seal 55. As is known in the art, the water seal 55 prevents the escape of gas from the interior of the gasifier 10 while permitting relative motion between the seal shirt and the ash pan 38.

A pipe 56, which extends horizontally below the pan floor 40, has one end connected to a source (not shown) of a mixture of air and steam, and the other end, which terminates below the pan floor 40, is connected to an inverted-Y connector 57. A vertically-extending pipe portion 57*a* of the connector 57 is positioned substantially coaxially with the funnel 48. A conventional fluid seal 58 interconnects the pipe portion 57*a* and the funnel 48 to permit rotation of the grate assembly 44 relative to the stationary connector 57 while preventing the escape of the steam-and-air mixture from the pipe portion 57*a*. The ashes which fall through the grate elements 46*a* are collected in the funnel 48 and a lower vertical portion 57*b* of the connector 57, which is in fluid communication with a water pipe 59. A supply of water flows through the water pipe 59, and is controlled by known means, such as valves. The collected ashes are mixed with the water flowing through the water pipe 59 to form a slurry of ashes and water, which is pumped into the ash pan 38.

The gasifier 10 is provided with a plurality of pokeholes 60, one of which is shown in FIG. 1, which is positioned around the circumference of the casing 12, at the approximate level of the supports 14 and 14*a*. The pokeholes 60 provide access to the interior of the gasifier 10 through which pokerods may be inserted to manually agitate the coal bed, to determine the presence of clinkers, and to determine the temperature of the coal bed, in a conventional manner known in the prior art, as described above.

Figure 3:
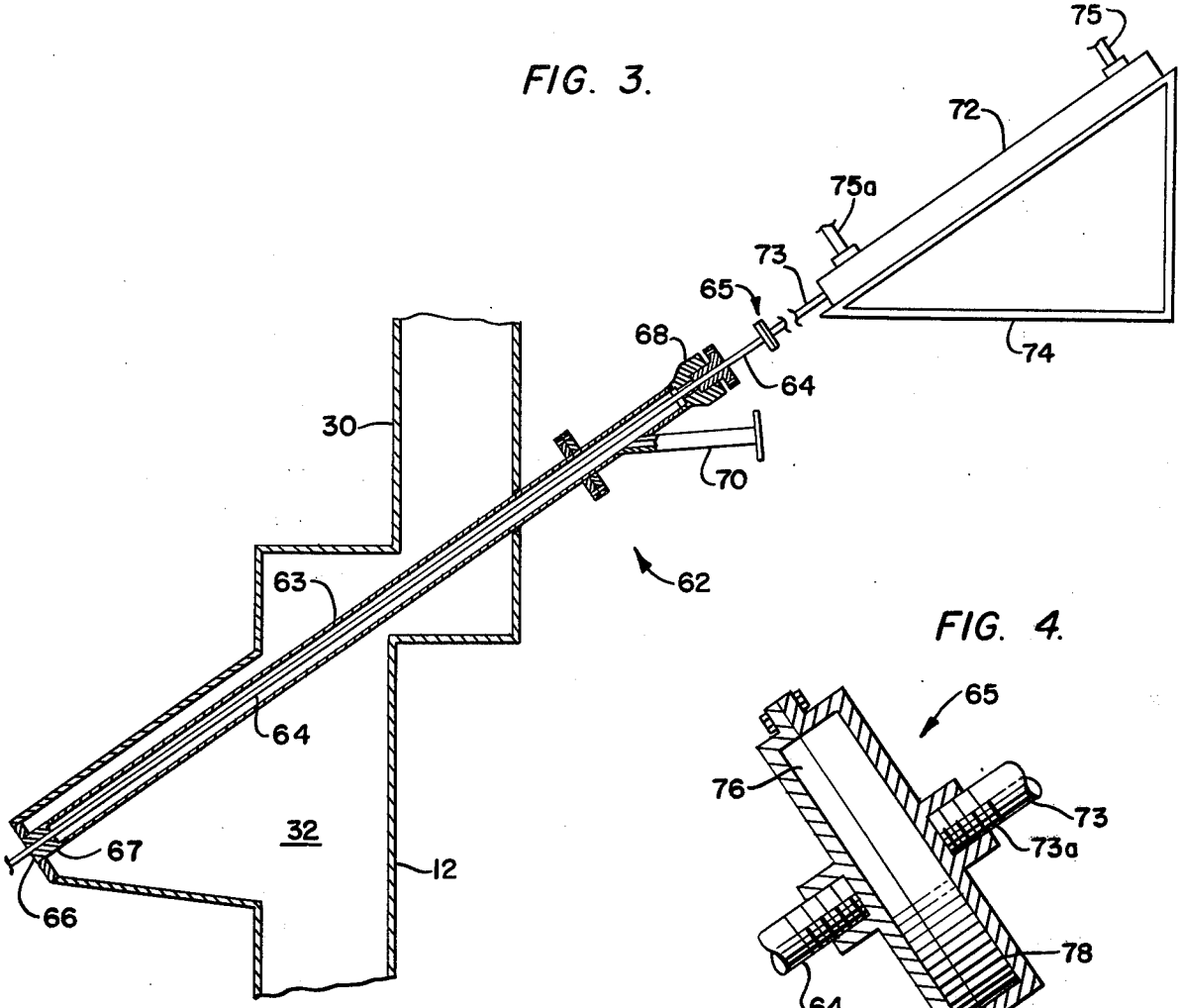
FIG. 3 is a side elevational view of one of the pokerod assemblies shown in FIG. 1, with some of the structural elements shown in section.

At an elevation lower than that of the pokeholes 60 the casing 12 is provided with a number of pokerod assemblies, one of which is shown in FIG. 1 and denoted generally by the reference character 62, which are mounted around the exterior circumference of the gasifier 10. As shown in FIGS. 1 and 3, the pokerod assembly 62 includes a hollow, cylindrical mounting tube 63 which protrudes into the steam chamber 32 at a downward angle, such as an angle of 35°. A pokerod 64 extends through the mounting tubes 63 and is of sufficient length that when fully extended, the pokerod penetrates the entire depth of the coal bed and extends to approximately the centerline of the gasifier 10. As an example only, the pokerod 64 may be of stainless steel construction, and approximately one-inch in diameter. The exterior end of the pokerod 64 extends a short distance beyond the mounting tube 63, and is provided with a coupling 65 which, for example, may include a threaded attachment member, as described below.

Referring to FIG. 3, the mounting tube 63 is appropriately secured to the inner casing 30 and the casing 12, such as by welding. An opening 66 is provided in the inner casing, adjacent to the mounting tube 63, through which the pokerod 64 extends. The inner end portion of the mounting tube 63 is appropriately closed, such as by a perforated sleeve 67. The end of the mounting tube 63 terminates in an enlarged housing 68 for receiving a conventional bearing (not shown) which permits the sliding movement of the pokerod 64 through the mounting tube, and a packed gland (also not shown) for sealing the interior of the mounting tube. While not specifically shown in the drawings, it is understood that the bearing and the packing gland may be of any suitable design.

The mounting tube 63 is provided with a steam inlet 70, adjacent to the housing 68, through which purge steam at a relatively high pressure, such as 25 psig, is introduced into the interior of the mounting tube 63 to create a higher pressure atmosphere within the tube. This atmosphere prevents the entry of gas into the mounting tube 63 from the interior of the gasifier 10 which may adversly affect the proper and efficient operation of the pokerod assembly 62. A small quantity of the purge steam may pass through the sleeve 67 which closes the inner end portion of the mounting tube 63. However, the passage of a relatively small quantity of steam into the gasifier 10 has a negligible effect on the overall operation of the gasifier. A suitable source (not shown) is provided to supply the high-pressure purge steam to the inlet 70. The source of the purge steam is different from the steam chamber 32, which has been described above, since the steam in the steam chamber is at a relatively low pressure, on the order of 5 psig.

With continuing reference to FIG. 3, a hydraulically-actuated cylinder 72 having a piston shaft 73 reciprocally received therein is attached to a support 74 such that the shaft is lineraly aligned with the pokerod 64, and is connected to the pokerod at the coupling 65. Fluid couplings 75 and **75*a* are positioned adjacent to the ends of the hydraulic cylinder 72, and are connected to an appropriate source of pressurized fluid (not shown). The hydraulic cylinder 72 may be of the double-acting type in which, for example, pressurized fluid introduced into the hydraulic cylinder through the fluid coupling 75 will cause the shaft 73 to extend from the cylinder, and in turn cause extension of the pokerod 64 from the mounting tube 63. Introduction of the pressurized fluid through the coupling 75*a*, positioned at the opposite end of the hydraulic cylinder 72, will cause retraction of the shaft 73, and thus a corresponding retraction of the pokerod 64 within the mounting tube 63**.

Figure 4:
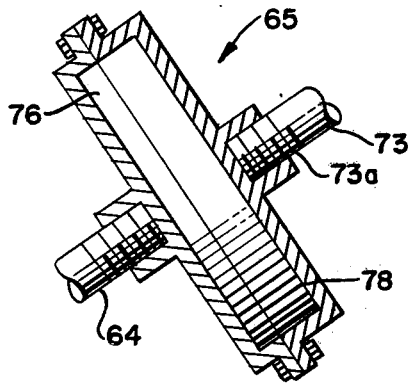
FIG. 4 is a cross section of the coupling for joining the pokerod and the motive means for extending and retracting the pokerod.

As shown in FIG. 4, the end of the piston shaft 73 may be provided with a threaded portion **73*a* attached to the coupling 65. A similar portion 64*a* is provided on the pokerod 64 and attached to the coupling 65. Disposed within the coupling 65 is a load sensor 76 which registers the amount of force, in compression or tension, applied to the pokerod 64 by the hydraulic cylinder 72 during extension and retraction, respectively, of the pokerod. The load sensor 76** may be of any suitable type designed to convert an applied force into an electrical signal which can be registered and recorded, such as a strain gauge.

Also shown in FIG. 4 is a position sensor 78 connected to the pokerod 64 and the piston shaft 73. The position sensor 78 indicates the displacement of the piston shaft 73 relative to a reference point and thus indicates the relative position of the pokerod 64. For example, if the fully retracted position of the piston shaft 73 is the reference point and corresponds to the fully retracted position of the pokerod 64 within the mounting tube 63, then the movement of the piston shaft from this reference position can be detected by the position sensor 78 and correlated to the movement of the pokerod to permit the monitoring of the extension and retraction of the pokerod.

The position sensor 78 may be of any suitable type. As an example only, a rotary position sensor available as the PF-1010 position sensor from Jordan Controls, Inc., Milwaukee, Wisconsin, may be utilized. This particular position sensor provides an electrical feedback signal from a controlled movable element, which in the present instance would be the piston shaft 73, and includes a potentiometer coupled to the input shaft of the sensor through an enclosed gear train. The piston shaft 73 is suitably connected to the input shaft of the position sensor 78, and displacement of the piston shaft is translated by the gear train of the sensor into a feedback signal representative of displacement of the piston shaft.

It is understood, of course, that while not specifically shown in the drawings, the load sensor 76 and the position sensor 78 are provided with the appropriate wires which connect them to a suitable recording instrument, also not shown, for displaying and if desired, recording the force and position registered by the respective sensors.

The use of threaded couplings to join the piston shaft 73 and the pokerod 64 permits easy connection and separation of these elements to facilitate the replacement of the pokerod and/or the load sensor 76 and position sensor 78 if necessary. Of course other methods may be used to connect the piston shaft 73 and the pokerod 64.

Figure 5:
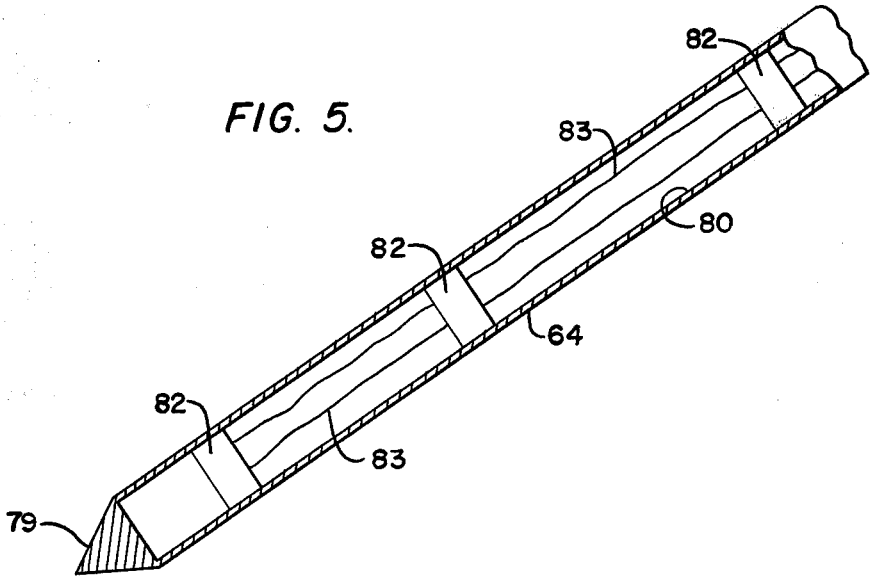
FIG. 5 is a cross section of a portion of the pokerod which extends into the coal bed, illustrating the location of the temperature sensors within the pokerod.

Shown in FIG. 5 is the inner end portion of the pokerod 64 which, in the extended position, is positioned within the coal bed adjacent to the lower portion of the gasifier 10. The end of the pokerod 64 is provided with a taper 79 to facilitate penetration of the coal bed, and the pokerod itself is provided with a central bore 80 which extends substantially the entire length of the pokerod. Positioned within the central bore 80 is a set of thermocouples 82 which are equally spaced within that length of the pokerod which, with the pokerod in its extended position, would normally be buried within the coal bed. By way of illustration only, the exposed length of the pokerod 64 may be approximately four feet, and each of a set of four thermocouples 82 would be spaced approximately one-foot apart. Each of the thermocouples 82, which may be of conventional construction and operation, is suitably positioned in thermal contact with the wall of the pokerod 64 so as to accurately register the temperature sensed by the pokerod at the position at which the thermocouple is located. As indicated above, the pokerod 64 extends into the coal bed at an angle, such as 35°, so that with the thermocouples evenly spaced along the length of the pokerod which is buried in the coal bed, a temperature indication reading is provided at different heights within the coal bed. Wires 83 connect the thermocouples 82, exit through the central bore 80 of the pokerod 64, pass out through the pokerod, and are connected to a suitable registering and recording instrument (not shown) for displaying and recording the temperature reading of each of the thermocouples.

As shown in FIG. 1, a second set of pokerod assemblies 84 is provided in the upper, or distillation zone, of the gasifier 10. Each of the second set of pokerod assemblies 84 is structurally and functionally identical to the pokerod assembly 62 described above, with the exception that the stroke of hydraulic cylinder 86, which extends and retracts the pokerod 87, is shorter since the pokerod 87 does not have to extend the same depth into the coal bed as the pokerod 64 for the pokerod assembly 62. The primary purpose of the pokerod assembly 84 in the distillation zone of the gasifier 10 is to agitate or poke the coal bed to release the gases from the particles of high-free swelling index coal heated in the absence of oxygen to reduce excessive swelling and agglomeration of the coal bed, and thus present clogging of the distillation zone of the gasifier. It is understood that while not specifically shown in FIG. 1, sensors similar to the thermocouples 82 above would be provided in the pokerod assemblies 84 to indicate the temperature of the coal bed.

In operation, the coal gasifier 10 is started and fired in a conventional manner. Coal is introduced through the inlet 18, until a bed of coal is provided within the gasifier 10 which substantially fills the gasifier. Combustion and gasification of the coal within the gasifier 10 occur in a continuous fashion, with the coal in the fire zone, which extends approximately twelve inches above the surface of the grate 46, having the highest temperature.

A portion of the hot gas produced by the burning coal in the fire zones passes upwardly through the upper portion of coal in the gasifier 10 to drive off the volatile substances, such as tar and other organic matter, from the coal in the distillation zone. The volatile substances, mixed with the combustion gas which have subsequently cooled as a result of its passage through the distillation zone, pass through the gas outlet 20, and to a suitable particle separator (not shown), such as an electrostatic precipitator.

The remaining portion of the hot gas produced by the coal in the fire zone flows upwardly through the annular chamber 26 in the tubular liner 24, and collects within the enlarged section 27 of the chamber, and subsequently flows through the second gas outlet 28 and the conduit 29. The conduit 29 conducts the hot gas to another particle separator (not shown), such as a cyclone separator, which removes the particulate matter from the combustion gas. After passing through the respective particle separators, the gases from the outlets 20 and 28 are mixed in the appropriate proportions, and subsequently supplied to a burner adapted for burning such low-BTU gas. The gas which is collected in the annular chamber 26 has a higher, latent heat than the gas which passes through the distillation zone and through the gas outlet 20. The gas passing through the outlet 20, because of its higher content of volatile substances, possesses a higher heat content, or a higher BTU content.

At the appropriate time, which may be sometime after the gasifier 10 is in full operation, pressurized hydraulic fluid is supplied to each of the hydraulic motors 53, to cause rotation of the gear 54 and the ratchet wheel 52, thereby rotating the ash pan 38 and the grate assembly 44. As the grate assembly 44 rotates, each of the grate elements **46*a* tends to sweep the ash from the lower layer of coal in the fire zone into the water within the ash pan 38. A small quantity of fine ash may fall through the perforations of the grate 46, and is collected in the funnel 48. From the funnel 48, the fine ash particles drop into the lower vertical portion 57*b*, and are mixed with a controlled quantity of water flowing through the water pipe 59. Although not shown in the drawings, it is understood that the water pipe 59 is connected to the ash pan 38 so that the slurry of fine ashes and water is introduced into the water and ash solution within the ash pan. Suitable means which have not been shown in the drawings, remove the ashes which have settled to the floor 40 of the ash pan 38**.

To sustain the gasification process, a steady flow of air and steam is introduced into the interior of the gasifier 10 through the pipe 56, the connector 57, the upper vertical pipe portion **57*a* and the grate assembly 44, which reacts in a known manner with the burning coal to produce the low-BTU gas. Heat produced by the burning coal within the fire zone converts a portion of the water in the steam chamber 32 to steam, which is removed through the steam outlet 34. The removed steam, further vaporized by being passed through a venturi (not shown), is mixed with incoming air, and introduced into the gasifier 10 through the pipe 56**.

At predetermined intervals, each of the pokerod assemblies 62 is activated to extend the pokerod 64 into the coal bed to agitate the bed and to measure the temperature within the bed. Activation of each pokerod assembly 62 is achieved by introducing pressurized fluid into its corresponding hydraulic cylinder 72 to extend the pokerod 64 from the mounting tube 63, in the manner described above. The amount of force exerted upon the pokerod 64 by the hydraulic cylinder 72 is measured by the load sensor 76. An abnormally high reading on the load sensor 76 would most probably result from the increased resistance of a clinker in the coal bed to passage of the pokerod 64, which will produce a higher force value registered on the load sensor. The concurrent data registered by the position sensor 78 will indicate the location of the clinker. The clinker may be broken by repeated agitation with the pokerod 64.

The thermocouples 82 located within the pokerod 64 register the coal bed temperature.

By activating each of the pokerod assemblies 62 in the above manner, the coal bed is agitated and clinkers broken to ensure uniform burning of the coal and efficient operation of the gasifier 10. A temperature profile is provided to permit regulation of the fuel supply and/or the steam-air mixture for optimum operation of the gasifier.

Also at predetermined intervals, each of the pokerod assemblies 84 positioned around the distillation zone of the gasifier 10 is activated to cause extension of the pokerod 87, from the retracted position within the mounting tube to the extended position within the coal bed in the distillation zone, to agitate the coal bed and thereby liberate gases from the burning coal to reduce the swelling of the coal. By employing the pokerod assemblies 84, coal having a free swelling index greater than 2.7, which ordinarily could not be used as a fuel in a gasifier, may also be utilized to enhance the economic attractiveness of the coal gasifier.

Figure 6:
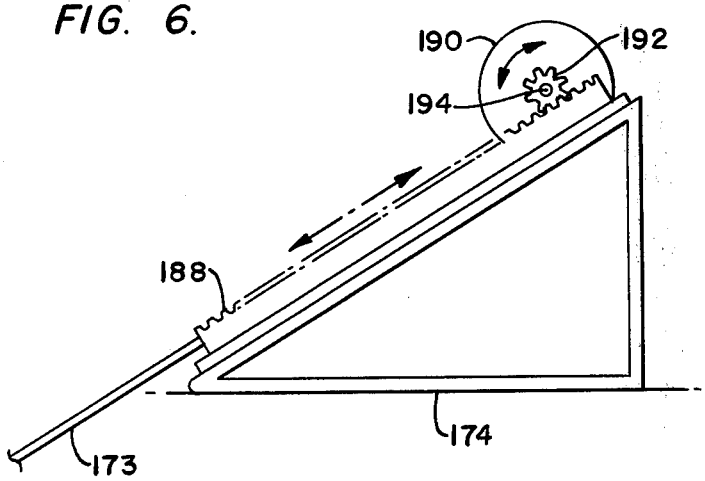
FIG. 6 is a side elevational view of an alternate embodiment of the motive means for extending and retracting the pokerod of the present invention.

An alternate embodiment of the mechanism for activating the pokerod assemblies is illustrated in FIG. 6, in which corresponding parts have been designed by the same reference numerals as part of the "100" series. As shown, the upper end portion of the piston shaft 173, instead of being connected to a hydraulic cylinder as shown in FIGS. 1–5, is attached to a toothed rack 188 slidably disposed on a support 174. Suitably supported in a cooperative position with the rack 188 is an electric motor 190 having a pinion gear 192 secured to a shaft 194 rotatably driven by the motor, with the teeth of the pinion gear meshing with the teeth of the rack 188. Energization of the electric motor 190 causes rotation of the pinion gear 192, which in turn causes longitudinal movement of the rack 188. The electric motor 190 is preferably of the reversible type so that the pinion gear 192 can be rotated clockwise and counter-clockwise, as viewed in FIG. 6, to cause downward movement of the rack 188, and therefore the extension of the pokerod (not shown), or upward movement of the rack to cause retraction of the pokerod. The load and position sensors, and the operation of the pokerod are identical to that described above relative to FIGS. 1–4.

Instead of the temperature sensors, or the thermocouples being installed within bored-out portions of the pokerods 64, each of the pokerods can be of solid construction, and functions primarily to agitate the coal bed and to detect the presence of clinkers. The temperature-sensing function is achieved by a set of eight temperature sensors which are divided into two sets of four, with each set located approximately 180° apart on the lower periphery of the casing 12 of the gasifier 10. One set of temperature sensors is shown in FIG. 1, and is identified with reference numerals 200–203. Each of the temperature sensors 200–203 includes a tubular housing 204 which extends through the casing 12 and the inner casing 30, with the inner end portion of the housing terminating just inside the inner casing within the coal bed in the fire zone of the gasifier 10. The outer end portion of the housing 204 is closed with a cover 205, and a suitable temperature sensing device (not shown), such as a thermocouple, is inserted into the housing and positioned in contact with the interior end of the housing to register the temperature of this portion of the housing, which will be substantially identical to the temperature of the coal bed adjacent to and in contact with this end portion of the housing. The thermocouples are properly connected to a conventional indicator and recording instrument (not shown).

As shown in FIG. 1, each of the temperature sensors 200–203 is equally spaced vertically so that the temperature at different heights within the fire zone may be measured. With this modification to the temperature sensors, the automated pokerod assembly 62 is operated in the fashion described above, except that temperature readings are not obtained during the pokerod activation. Instead, the temperature at four different heights within the fire zone of the coal bed are continuously monitored. With two sets of four temperature sensors each, the temperature at eight different locations within the fire zone can be monitored. In the same fashion that solid pokers and temperatures sensing are achieved in the lower zone, a set of eight sensors are provided in the distillation zone. Two sensors are provided, one at each of two different elevations in each of the four quadrants of the distillation zone.

While not specifically shown, the flow of the gas through each of the outlets 20 and 28 are controlled by appropriate means, such as modulating valves, which permit flow regulation and mixing of the appropriate quantities of gas from each of these outlets. By use of such modulating valves, the quantity of gas which passes through either outlet may be controlled to suit the operational requirements.

Also, while not specifically described and shown in the drawings, it is understood that a single control panel may be provided which can be manned by a single operator from which the activation of the pokerod assemblies may be regulated and at which point the temperature, position and force data from the respective sensors may be displayed and permanently recorded. From this control panel, the operator can activate the pokerod assemblies according to a schedule, monitor the aforesaid data and the other operating indicia of the gasifier to ensure optimum and efficient operation of the gasifier.

Alternatively, the activation of the pokerod assemblies may be fully automated and be automatically performed according to a programmed schedule. Additionally, warning devices may be coupled to the sensors to provide a warning if any of the monitored parameters exceed acceptable values and require corrective action.

It is understood that while not specifically shown in the drawings to enhance the clarity of presentation, the gasifier, the poking assemblies, the temperature sensors, and other associated structures are appropriately mounted and supported to permit operation and cooperation in substantially the manner herein described.

Of course, variations of the specific construction and arrangement of the automated poking system disclosed above can be made by those skilled in the art without departing from the invention as defined in the appended claims.

We claim:

1. A pokerod assembly for agitating a coal bed comprising;

a housing adapted to be positioned adjacent to a coal bed;

an elongated member reciprocally disposed in said housing;

actuation means coupled to said elongated member for selectively extending and retracting said member respectively from and into said housing;

temperature sensing means associated with said elongated member for measuring the temperature at a selected location of said elongated member; and position sensing means associated with said elongated member for measuring the position of said member during the reciprocal movement of said member relative to said housing, said actuation means selectively extending and retracting said elongated member into and from said coal bed to agitate the coal bed, to detect clinkers in the coal bed, and to measure the temperature of the coal bed.

2. The assembly of claim 1, further including a force sensor associated with said elongated member for measuring the force exerted upon said member by said actuation means.

3. The assembly of claim 1, wherein said elongated member is provided with an internal chamber, and said temperature sensing means is disposed within said chamber.

4. The assembly of claim 3, wherein said temperature sensing means includes a plurality of thermocouples disposed in thermal contact with said elongated member.

5. The assembly of claim 1, wherein said actuation means includes a fluid-actuated cylinder having a shaft connected to said elongated member.

6. The assembly of claim 1, wherein said actuation means includes a reciprocal rack connected to said elongated member, a gear disposed in meshing engagement with said rack, and motive means for imparting rotation to said gear.

7. The assembly of claim 1, further including pressurized fluid means connected with said housing for pressurizing the interior of said housing to provide a fluid seal for said housing.

8. The assembly of claim 2, wherein said force sensor includes a transducer providing an output signal indicative of the force exerted upon said sensor.

9. In combination with a coal gasifier having a combustion chamber for receiving and supporting the burning of coal, a fuel inlet means for introducing coal into said combustion chamber, means for removing the gases of combustion, and means for supplying a mixture of steam and air into said combustion chamber, a poking system for agitating the coal, which comprises:

a support tube disposed adjacent and at an angle to said combustion chamber;

an elongated pokerod reciprocally disposed within said tube;

actuation means connected to said pokerod for controllably extending and retracting said pokerod relative to said tube;

position sensor means for producing a signal indicative of the position of said pokerod relative to said tube; and temperature sensor means for measuring the temperature of the burning coal within the combustion chamber, said actuation means selectively actuatable to extend and to retract said pokerod into and from the coal in said combustion chamber to agitate the coal and to detect clinkers in the coal.

10. The combination of claim 9, wherein said temperature sensor means includes a plurality of temperature sensors disposed to measure the temperature of the burning coal at different heights within said combustion chamber.

11. The combination of claim 10, wherein said pokerod is provided with an internal chamber, and said plurality of temperature sensors includes a plurality of thermocouples disposed within and in thermal contact with said chamber, and spaced along the portion of said pokerod immersed in the burning coal when said pokerod is in the extended position.

12. The combination of claim 10, wherein said plurality of temperature sensors includes a plurality of thermocouples, each of said thermocouples being disposed within a housing supported on said combustion chamber and in thermal contact with the burning coal.

13. The combination of claim 9, further including another poking system positioned on said combustion chamber at a higher elevation than said poking system, said another poking system including:

a second support tube disposed adjacent and at an angle to said combustion chamber;

a second elongated pokerod reciprocally disposed within said second tube;

second actuation means connected to said second pokerod for controllably extending and retracting said second pokerod relative to said second tube; and second position sensor means for producing a signal indicative of the position of said second pokerod relative to said second tube, said second actuation means selectively actuatable to extend and to retract said second pokerod into and from the coal in the upper portion of said combustion chamber to agitate the coal, to reduce swelling and agglomeration of the heated coal by releasing gases therein, and to detect clinkers in the coal.

14. The combination of claim 9, wherein said actuation means includes a fluid cylinder having a reciprocable shaft coupled to said pokerod.

15. The combination of claim 9, wherein said actuation means includes:

a reciprocable toothed rack coupled to said pokerod;

a gear positioned in meshing engagement with said rack; and a reversible motor for imparting reversible rotation to said gear to reciprocally move said rack.

16. The combination of claim 9, further comprising a force sensor for measuring the force exerted upon said pokerod by said actuation means.

17. The combination of claim 9, further including means for supplying pressurized fluid to said tube for establishing a fluid seal in said tube.

18. The combination of claim 9, further including a fluid seal rotatably disposed adjacent to one end of said combustion chamber, and ash removal means connected to said fluid seal for rotation therewith.

19. The combination of claim 13, further including means for supplying pressurized fluid to said tube and to said second tube for establishing fluid seals in said tubes.

20. The combination of claim 13, wherein said combustion chamber is vertically positioned, and further including:

a fluid seal rotatably disposed adjacent to the lower end of said combustion chamber;

ash removal means disposed within said combustion chamber and having a rotatable grate assembly; and said support tube is disposed approximate the lower portion of said combustion chamber, and said second support tube is disposed in said combustion chamber above said support tube.

21. The combination of claim 13, further including second temperature sensor means for measuring the temperature of the coal in the upper portion of said combustion chamber.

22. The combination of claim 21, wherein said second temperature sensor means includes a plurality of temperature sensors disposed to measure the temperature of the coal at different heights within the upper portion of said combustion chamber.

23. The combination of claim 22, wherein said plurality of temperature sensors includes a plurality of thermocouples, each of said thermocouples being disposed within a housing supported on the upper portion of said combustion chamber and in thermal contact with the coal.

24. The combination of claim 22, wherein said second pokerod is provided with an internal chamber, and said plurality of temperature sensors includes a plurality of thermocouples disposed within and in thermal contact with said chamber, and spaced along the portion of said second pokerod immersed in the coal when said second pokerod is in the extended position.

* * * * *